US006151820A

United States Patent [19]

Kubli

[11] Patent Number: 6,151,820

[45] Date of Patent: Nov. 28, 2000

[54] STAMPED BASED PLATE FOR INTERIOR SIGNAGE

[75] Inventor: Stefan Kubli, Rochester, Mich.

[73] Assignee: Infonorm, Inc., Rochester Hills, Mich.

[21] Appl. No.: 09/342,998

[22] Filed: Jun. 29, 1999

[51] Int. Cl.[7] ..... G09F 7/02

[52] U.S. Cl. ..... 40/605; 40/618

[58] Field of Search ..... 40/605, 611, 618, 40/620, 657, 622, 124.4

[56] References Cited

U.S. PATENT DOCUMENTS 959,896 5/1910 Staren ..... 40/605

FOREIGN PATENT DOCUMENTS 548080 4/1974 Switzerland .
645202 9/1984 Switzerland .
658925 12/1986 Switzerland .
658181 4/1995 Switzerland .
687570 12/1996 Switzerland .

*Primary Examiner*—Cassandra H. Davis
*Attorney, Agent, or Firm*—Reising, Ethington, Barnes, Kisselle, Learman & McCulloch, P.C.

[57] ABSTRACT

A stamped base plate (16) for a signage assembly (10) that includes elongated slots (20, 40) and canted flanges (18, 38) that engage a back channel of an elongated sign plate (12). The base plate has protrusions (34) that engage hook (30) of an end cap (14). The base plate can be cut to length at score lines (44) aligned with the slots (20, 40).

10 Claims, 4 Drawing Sheets

STAMPED BASED PLATE FOR INTERIOR SIGNAGE

TECHNICAL FIELD

The field of this invention relates interior signage and more particularly to a base plate, for modular interior signage.

BACKGROUND OF THE DISCLOSURE

Interior signage is very useful for hospitals, educational campuses, museums, and office buildings for room identification, personnel identification, directions, and directories. Modular signage has become popular because of its particularly advantage when there are frequent changes in personnel, relocation of internal departments, or other information. When one portion of the signage needs revision, a particular element or section can be replaced with the other labels remaining untouched or merely relocated.

Modular signage includes individual elongated labels or plates that are individually mounted onto a base plate. End caps are then spring mounted to aesthetically trim out the signage and to deter casual and unauthorized removal of the end cans and labels.

The elongated plates are mounted on a singular base plate that has beveled channels running almost the entire width of the plate. The plate made from aluminum needs to have the channels machined therein which is a costly operation. The base plate needs to be sized at the factory and is not amenable to change in size at the end site of the signage. As such, blank elongated plates are often used as filler when fewer labels are needed. These blank spots are often undesirable from both an aesthetic and marketing viewpoint.

What is needed is a base plate for a modular signage assembly that can be easily mounted on a wall and can be easily manufactured and easily cut to length on site as needed.

SUMMARY OF THE DISCLOSURE

In accordance with one aspect of the invention, a modular interior signage assembly includes a plurality of elongated sign plates each with a rear facing open-ended channel with undercut side flanges. A pair of base plates for attaching to a substrate such as a wall or other platform are spaced apart to be in proximity to respective opposing ends of the elongated sign plates. Each base plate has a first set of a plurality of elongated cutouts that extend between opposing edges of the base plate. A first set of a plurality of flanges on the base plate extend from opposing edges of the elongated cut outs for engagement to the undercut side flanges of the rear facing channel of the elongated sign plates. The flanges retain the elongated plates laterally on said base plate. Preferably the flanges are canted outwardly from the base plate. The undercut side flanges have a bevel cant to complement the canted angle of the flanges.

End caps engage a respective outer edge of each base plate. Preferably, a spring clip is interposed between two adjacent flanges of the first set. Preferably, the end cap has a hook that is inserted in a gap between the elongated plate and the base plate and engages a protrusion interposed between the edge of the base plate and the first set of flanges. The spring clip biases the hook section to retain engagement with said protrusion. The spring clip has a rear extending leg portion that is engageable in an aperture through the base plate positioned between the two adjacent flanges.

It is desirable that the base plate has a second set of cutouts spaced toward an inner lateral edge of the base plate.

The second set of cutouts has a second set of flanges at opposing edges of the elongated cut outs of the second set. The flanges engage the undercut side flanges of the rear-facing channel of elongated sign plates to retain the plates laterally on the base plate. The second set of flanges are staggered with respect to the first set of flanges to retain every other elongated sign plates at different positions from the plates retained by the first set of flanges. In one embodiment, the first set of elongated slots and second set of slots are horizontally aligned and spaced apart to form a cuttable web therebetween. The web is scored to promote ease of cutting or fragmenting at the score. The base plate can be cut to length at the web and at each edge aligned with a cutout from the first set and a cut out from said second set.

In accordance with another aspect of the invention, a base plate for a modular signage assembly includes a first set of a plurality of elongated cutouts that extend between opposing edges of the base plate. A first set of flanges on the base plate extend from opposing edges of the elongated cut outs for engagement to undercut side flanges of a rear facing channel in an elongated sign plate to retain the elongated plates laterally on the base plate. Preferably, the base plate has a second set of cutouts spaced toward an inner lateral edge of said base plate. The second set of cutouts have a second set of flanges extend from the edge of the elongated cut outs of the second set. The flanges are engageable to the undercut side flanges of the rear-facing channel of the elongated sign plates. The flanges retain the plates laterally on the base plate. The second set of flanges are staggered with respect to the first set of flanges to retain said elongated sign plates at different positions than the first set of flanges.

BRIEF DESCRIPTION OF THE DRAWINGS

Reference now is made to the accompanying drawings in which.

DETAILED DESCRIPTION OF THE PREFERRED EMBODIMENT

Figure 1:
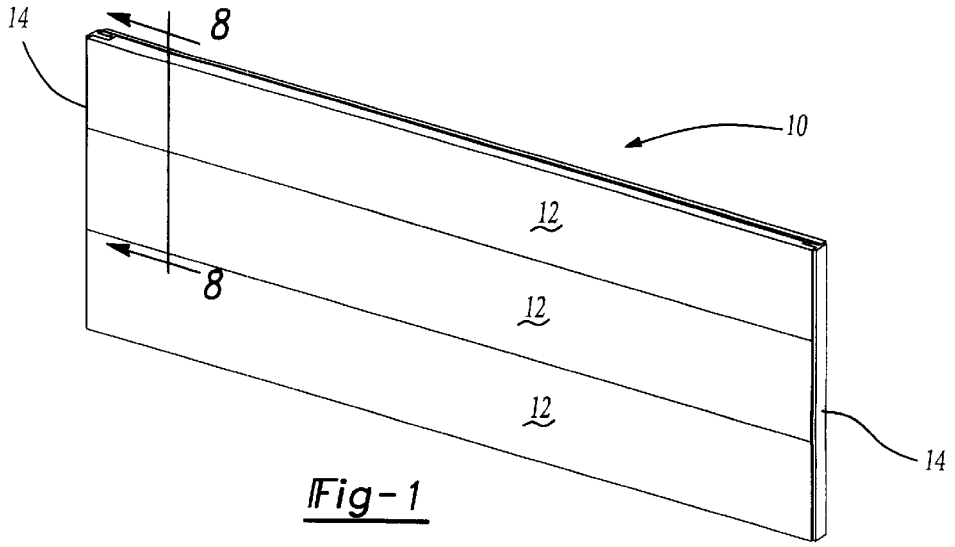
FIG. 1 is a perspective view of an assembled modular sign in accordance with one embodiment of the invention.

Referring now to FIG. 1, a modular sign 10 is shown in the assembled condition with a plurality of elongated sign plates 12 and two end caps 14. These elongated sign plates 12 and end caps 14 are well known in the art and are commercially available from Infonorm Inc.

Figure 2:
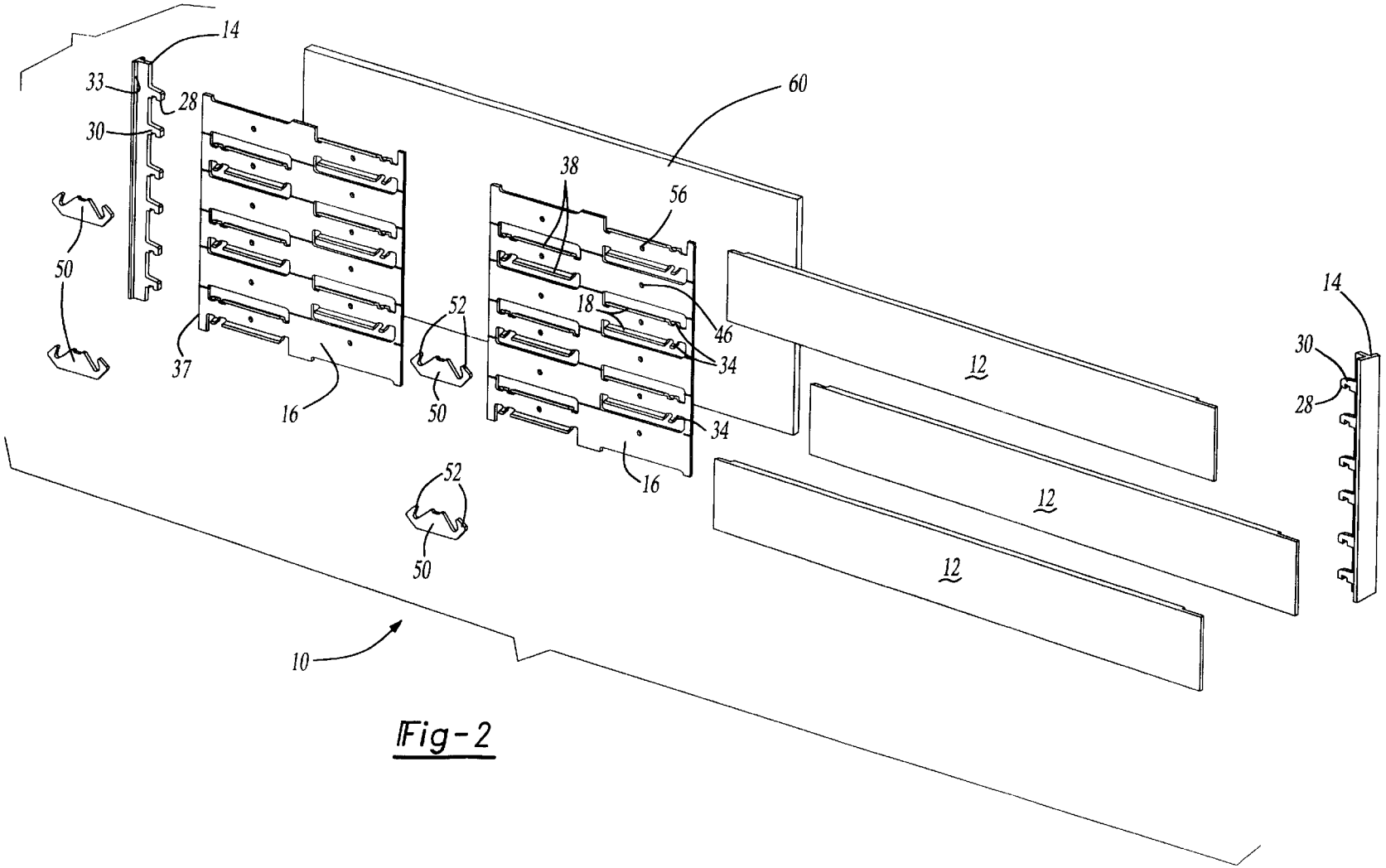
FIG. 2 is an exploded view of the modular sign shown in FIG. 1.
Figure 4:
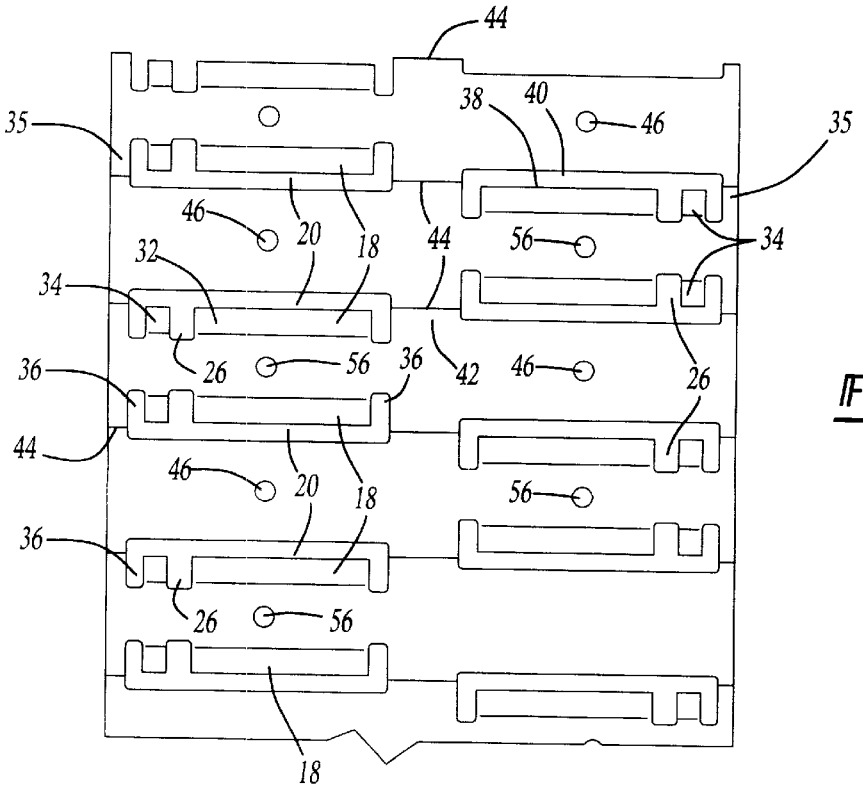
FIG. 4 is an enlarged back plan view of the base plate shown in FIG. 3.

As shown in FIG. 2, the sign 10 is illustrated in the exploded and disassembled condition that exposes two backing plates 16. Each backing plate 16 is made from stamped aluminum. The backing plates 16 mount the elongated sign plates 12 and end caps 14 through spring clips 50, and in turn are mounted to a wall or platform or other appropriate substrate 60.

Figure 3:
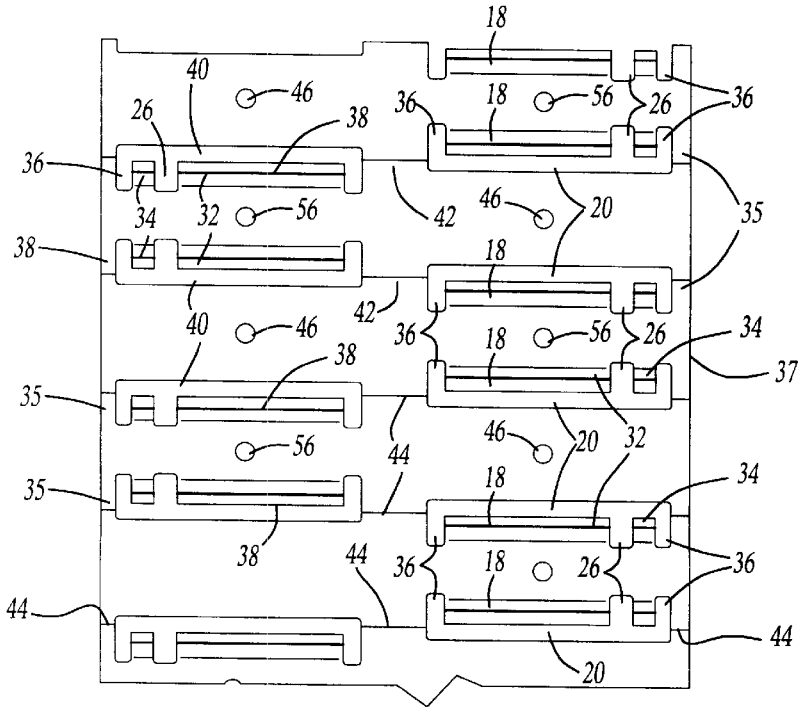
FIG. 3 is an enlarged front plan view of one base plate shown in FIG. 2.
Figure 5:
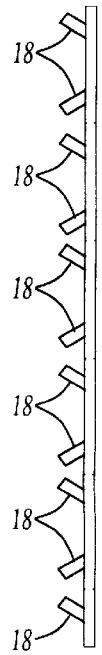
FIG. 5 is an end view of the plate shown in FIG. 3.

As shown in FIG. 3, a first column of flanges 18 and elongated slots 20 are stamped in the backing plate. The elongated slots and flanges extend generally in the horizontal direction. The flanges 18 are bent from opposing edges 19 of sequential slots 20 to cant generally forwardly as illustrated in FIG. 5. The angle of the flange 18 corresponds to the undercut bevel 22 of rear facing, open-ended channels 24 in the elongated sign plates 12, as clearly illustrated in FIG. 8. Each flange has a notch 26 therein for receiving a distal end 28 of a hook 30 on end cap 14. The notch 26 breaks up flange 18 into a long section 32 and a short section 34 of flange 18. The short section 34 may be referred to a protrusion for engagement with the hook 30 for maintaining the end cap onto the sign 10. Each elongated slot also has end legs 36 for ease in stamping and bending forward the flanges 18. The leg 36 outside of protrusion 34 is spaced from outer edge 37 of backing plate 16 to form a side support strip 35. The protrusion 34 and notch 26 are spaced from the outer edge 37 to retrofit the commercially available end caps 14 such that the hooks 30 are properly positioned and the edge 37 abuts against a rear lip 33 of the end cap 14.

Figure 6:
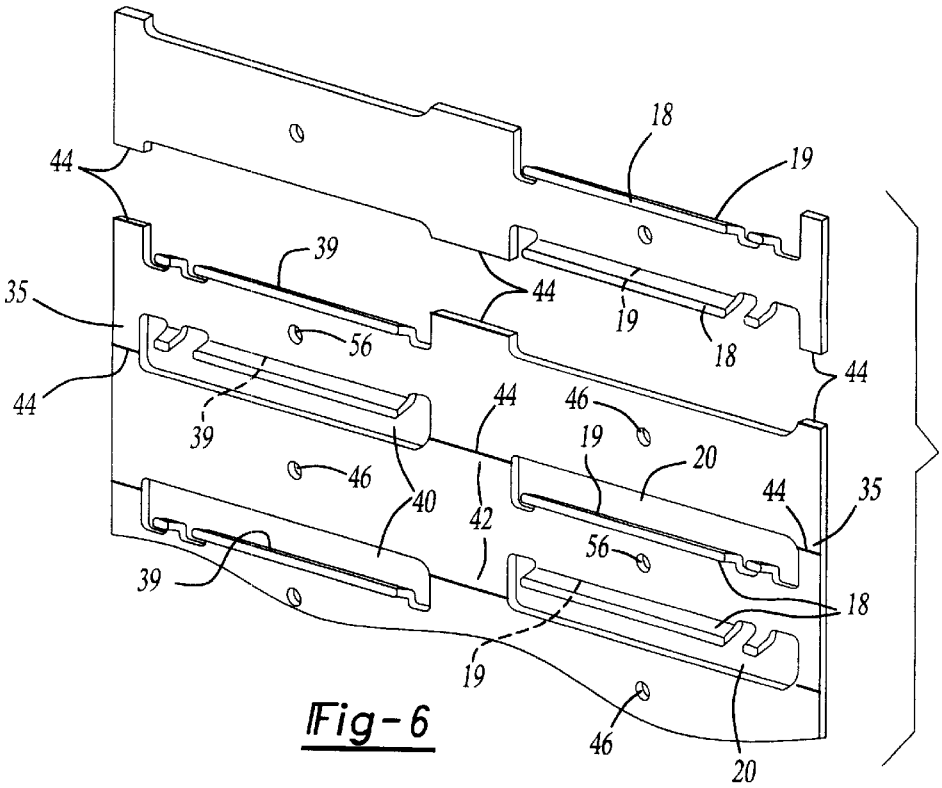
FIG. 6 is a fragmentary view of a backing plate broken along a score line.
Figure 7:
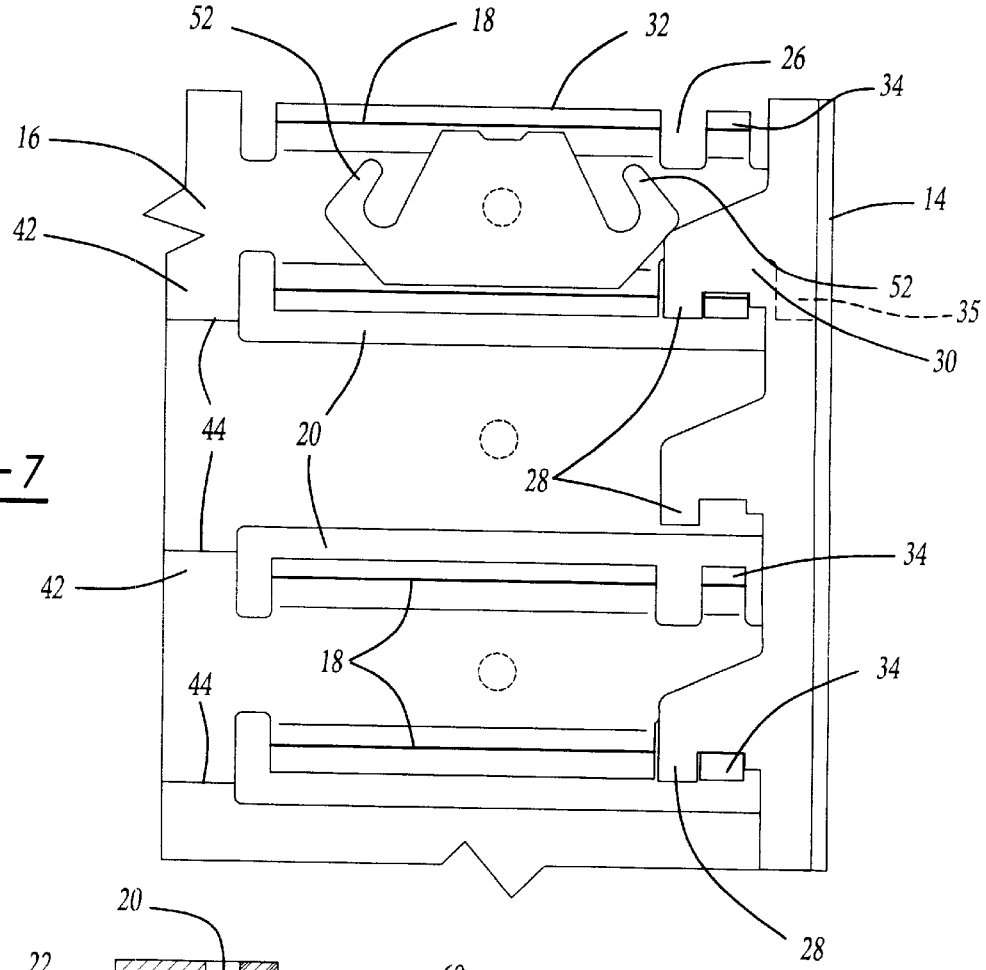
FIG. 7 is an enlarged fragmentary front plan view illustrating the mounting of the end cap.
Figure 8:
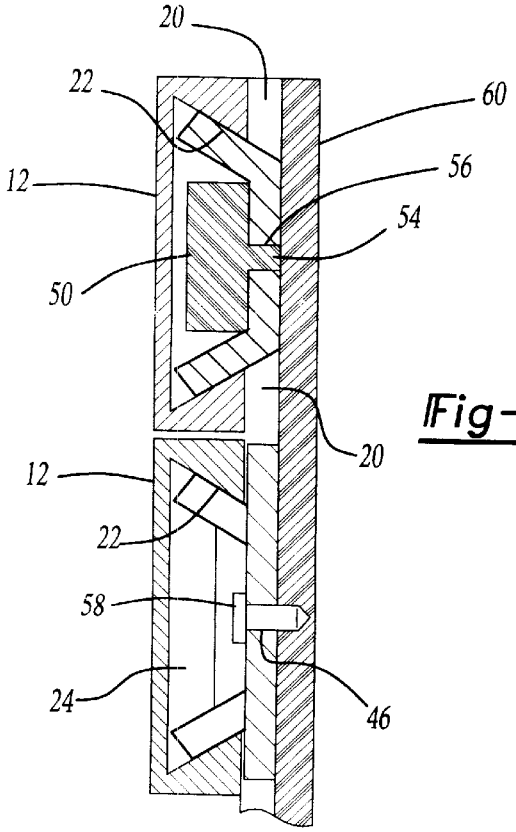
FIG. 8 is a cross-sectional view taken along lines 8—8 shown in FIG. 1.

The spring clip 50 has resilient legs 52 that engage the hook 30 to resiliently bias the hook 30 into the notch 26 and retain engagement of the hook 30 with the protrusion 34. As shown in FIG. 7 and 8, the spring clip 50 has a rear leg 54 that is pressed fitted or snap fitted into aperture 56 to be seated between two opposing flanges 18 as shown in FIG. 6. The spring clip 50 is also retained in its proper orientation by the flanges 18. The end cap can be manually assembled and disassembled onto and off of the sign 10 by overcoming the resilient bias of the leg 52. Preferably, springs 50 are mounted near the top and bottom of end cap 14.

A second column of flanges 38 and elongated slots 40 are in staggered relationship with the first sets 18 and 20. The construction of the flanges 38 and slots 40 are identical to flanges 18 and slots 20 apart from being mirror imaged and vertically staggered with respect to the first column. The flanges 38 extend from opposing edges 39 of sequential slots 40. Like components of these flanges 38 and slots 40 have the same numerals as labeled for the first sets 18 and 20. The flanges are staggered such that adjacent single width elongated sign plates 12 are mounted alternately to flanges 18 of the first column and flanges 38 of the second column.

The elongated slots 40 are aligned with the elongated slots 20 such that an intermediate web 42 is formed between the slots 20 and 40. Each web 42 is vertically aligned with respective side support strips 35. Each web 42 and strip 35 is scored to promote fragmentation and cutting along the score lines 44 as illustrated in FIG. 6.

Referring now to FIGS. 2 and 8, each backing plate 16 is mounted onto a wall or other platform 60 by adhesive or fasteners 58 passing through mounting holes 46. The backing plates 16 are each cut along the desired score line 44 as shown in FIG. 6 to the desired length to accommodate the desired number of elongated plates 12. The backing plates 16 when mounted are appropriately spaced to accommodate the desired length of the elongated plates 12.

In this fashion, stamped backing plates 16 can replace expensive machined backing plates. The backing plates can be cut and arranged to accommodate a wide variety of sign sizes. The cutting can be done on site during installation of the sign. The staggered nature of the first set of flanges 18 and slots 20 and second sets of flanges 38 and slots 40 provided for a symmetrical backing plate 12 with no need for concern of left or right handedness while providing for a structurally supportive center web 42.

Variations and modifications are possible without departing from the scope and spirit of the present invention as defined by the appended claims.

The embodiments in which an exclusive property or privilege is claimed are defined as follows:

1. A modular interior signage assembly characterized by:

a plurality of elongated sign plates each with a rear facing open-ended channel with undercut side flanges;

a pair of base plates for attachment to a substrate and spaced apart to be in proximity to respective opposing ends of the elongated sign plates;

said pair of base plates having a first set of a plurality of elongated slots that extend between opposing edges of the base plate, a first set of flanges on said base plate at respective opposing edges of said elongated slots for engagement to said undercut side flanges of the rear facing channel of said elongated sign plates to retain said elongated sign plates laterally on said base plate;

a pair of end caps engageable to a respective outer edge of each base plate.

2. A modular interior signage assembly as defined in claim 1 further characterized by:

each of said base plates having a second set of slots spaced toward an inner lateral edge of a respective base plate, said second set of slots having a second set of flanges at respective opposing edges of said elongated slots of said second set for engagement to said undercut side flanges of the rear facing channel of said elongated sign plates to retain said elongated plates laterally on said pair of base plates, said second set of flanges being staggered with respect to said first set of flanges to retain said elongated sign plates at different vertical positions than the elongated sign plates mounted on said first set of flanges.

3. A modular interior signage assembly as defined in claim 2 further characterized by:

said slots of said first and second sets being aligned and spaced apart to form a cuttable web therebetween such that said base plates can be cut to length at said web and at each edge aligned with a slot from said first set and a slot from said second set.

4. A modular interior signage assembly as defined in claim 1 further characterized by:

said undercut side flanges of said sign plates having a bevel cant, said flanges of said pair of base plates being canted outwardly from said base plate to complement a canted angle of said undercut side flanges of said elongated sign plates.

5. A modular interior signage assembly as defined in claim 1 further characterized by:

a spring clip interposed between two adjacent flanges in said first set of flanges;

said end cap having a hook that engages a protrusion interposed between said edge of said base plate and said first set of flanges with said spring clip biasing said hook section to retain engagement with said protrusion.

6. A modular interior signage assembly as defined in claim 5 further characterized by:

spring clip having a rear extending leg portion that is engageable in an aperture positioned between said two adjacent flanges in each of said base plates.

7. A base plate for an interior signage assembly, said plate comprising:

a first set of a plurality of elongated slots that extend between opposing edges of the base plate, a first set of a plurality of flanges on said base plate at opposing edges of said elongated slots for engagement to undercut side flanges of a rear facing channel of an elongated sign plate to retain said elongated plates laterally on said base plate;

said base plate having a second set of slots spaced toward an inner lateral edge of said base plate, said second set of slots having a second set of a plurality of flanges on said base plate at opposing edges of said elongated slots of said second set for engagement to said undercut side flanges of the rear facing channel of said elongated sign plates to retain said plates laterally on said base plate, said second set of flanges being staggered with respect to said first set of flanges to retain said elongated sign plates at different positions than the elongated sign plates mounted on said first set of flanges.

8. A base plate for an interior signage assembly as defined in claim 7 further characterized by:

said first and second set of slots being aligned and spaced apart to form a cuttable web therebetween such that said base plate can be cut to length at said web and at each edge aligned with a slot from said first set and a slot from said second set.

9. A base plate for an interior signage assembly as defined in claim 8 further characterized by:

a protrusion interposed between said edge of said base plate and said first set of flanges that is engageable with a hook of an end cap and said channel between said flanges seatable with a spring clip that biases said hook to retain engagement of the protrusion with the hook.

10. A base plate for an interior signage assembly as defined in claim 7 further characterized by:

said flanges being canted outwardly from said base plate to complement undercut side flanges in said elongated sign plates.

* * * * *